United States Patent [19]

Bizzari et al.

[11] 4,175,228

[45] Nov. 20, 1979

[54] METHOD OF HOT BENDING A GENERALLY STRAIGHT WIRE BLANK

[75] Inventors: Venanzio Bizzari; Enar Högfors, both of Hallstahammar, Sweden

[73] Assignee: Bulten-Kanthal AB, Hallstahammar, Sweden

[21] Appl. No.: 828,072

[22] Filed: Aug. 26, 1977

[30] Foreign Application Priority Data

Sep. 3, 1976 [SE] Sweden ..... 7609774

[51] Int. Cl.[2] ..... B21F 3/027

[52] U.S. Cl. ..... 219/153; 219/154; 219/156

[58] Field of Search ..... 219/153, 154, 156

[56] References Cited

U.S. PATENT DOCUMENTS

| | | | |
|---|---|---|---|
| 458,115 | 8/1891 | Thomson | 219/153 |
| 475,181 | 5/1892 | Burton | 219/153 |
| 1,541,924 | 6/1925 | d'Adrian | 219/153 |
| 3,812,324 | 5/1974 | Faffaelli | 219/553 |

FOREIGN PATENT DOCUMENTS

| | | | |
|---|---|---|---|
| 9379 | of 1892 | United Kingdom | 219/153 |

*Primary Examiner*—Richard R. Kucia

*Attorney, Agent, or Firm*—Pollock, Vande Sande & Priddy

[57] ABSTRACT

A method of hot bending a generally straight wire blank of a material being brittle in cold condition into a wire element having straight end portions and coils formed therebetween. According to the invention the rod blank is hot bent without a mandrel by clamping the end portions of the rod blank by means of two clamping jaws. The rod blank is heated to a softening temperature in the central wire portion which is to form the coils of the finished wire element, while the end portions are kept at a lower temperature. During the bending process at least one of the clamping jaws is brought along a movement path adapted to the desired coil formation.

10 Claims, 5 Drawing Figures

1
2
3
3a
3b
3c
4
5
6
P1
P2

METHOD OF HOT BENDING A GENERALLY STRAIGHT WIRE BLANK

BACKGROUND OF THE INVENTION

The invention relates to a method of hot bending a generally straight wire blank of a material being brittle in cold condition, especially a ceramic, refractory resistance material, such as a material consisting substantially of molybdenum disilicide, into a wire element having straight end portions and coils formed therebetween. Such wire elements are particularly useful as glow coils in gas ignition devices or the like.

Hitherto, when manufacturing such wire elements, the coils were formed through hot bending of the wire blank around a mandrel, e.g. of carbon (see e.g., U.S. Pat. No. 3,812,324). This known method, of course, enables a reliable control of the shape of the coils but has the disadvantage of impurities being transferred from the mandrel to the rod element during the hot bending and adversely affecting the quality of the finished rod element.

SUMMARY OF THE INVENTION

In accordance with the invention, it is suggested that the rod blank be hot bent without a mandrel, namely by (a) clamping the end portions of the rod blank, and keeping it free therebetween, by means of two clamping jaws movable relative to each other, and (b) heating the rod blank, preferably by conducting an electric current through same, to a softening temperature in the central rod portion which is to form the coils of the finished rod element, while the end portions are kept at a temperature lower than the softening temperature, whereupon at least one of the clamping jaws, during continued heating, is brought along a movement path adapted to the desired coil formation.

The electric current can be conducted through the wire blank via the clamping jaws, if the latter are made of an electrically conductive material. Further, the end portions of the rod blank can be kept at a lower temperature than the central portion of the rod by heat dissipation to the clamping jaws if these consist of material having high thermal conductivity. Thus the clamping jaws preferably consist of a metallic material, graphite, silicon carbide or some intermetallic material.

BRIEF DESCRIPTION OF THE DRAWINGS

The invention will now be described with reference to the annexed drawings, wherein FIG. 1 schematically shows the general method of the invention, and FIGS. 2*a–d* indicate the bending of the rod blank into a coil with 1½ turns.

DESCRIPTION OF A PREFERRED EMBODIMENT

Figures 1, 2A, 2B, 2C, 2D:
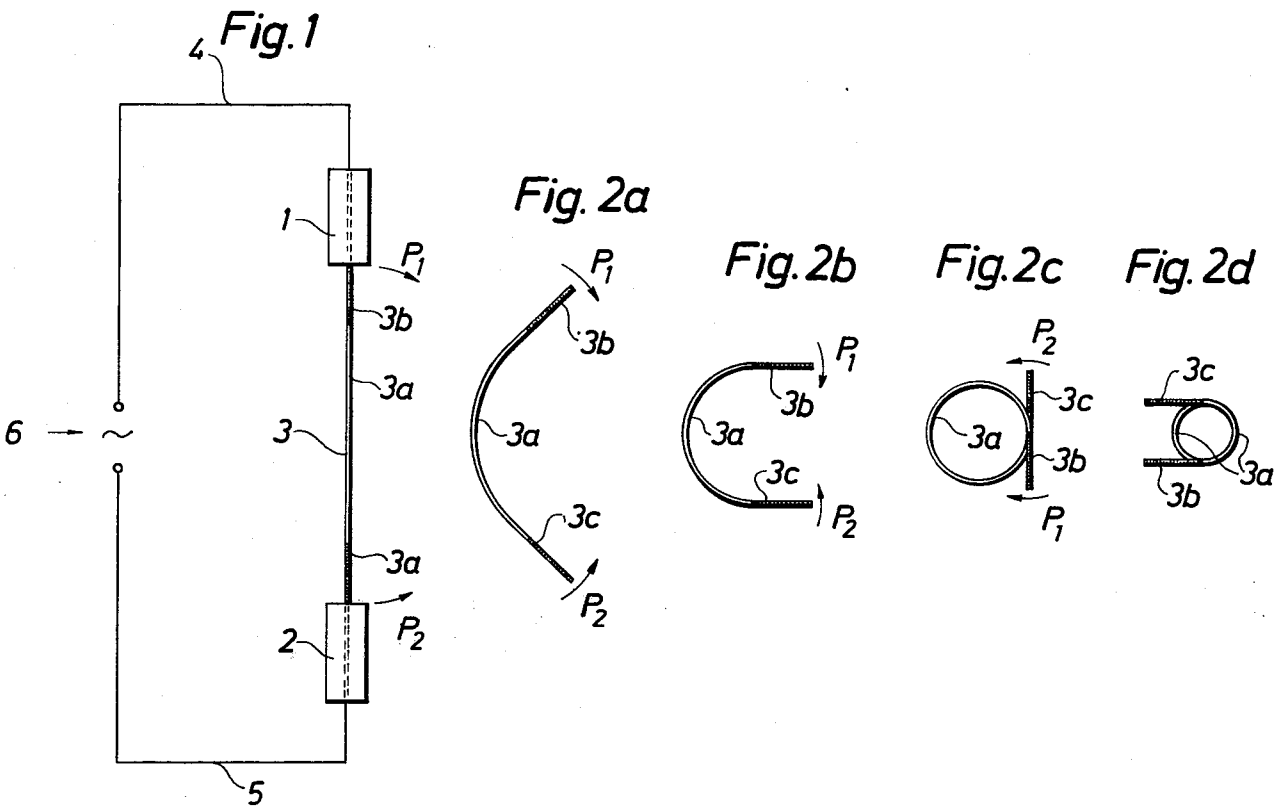

FIG. 1 shows two clamping jaws 1 and 2 made of metal, between which a rod blank 3 is clamped. The wire blank 3 consists, in this embodiment, substantially of disilicide, namely of the material sold under the trade mark KANTHAL SUPER, and, upon hot bending, is intended to serve as a resistive element in a gas ignition device or the like. The free portion of the rod, between the clamping jaws, is 40–100 mm long, preferably 57 mm, and the rod diameter is 0.4 to 1.0 mm, preferably 0.5 mm (these dimensions are adapted to a finished wire coil of 1½ turns according to FIG. 2*d*).

The metallic clamping jaws 1, 2 are connected via electrical leads 4,5 to the terminals of a current source 6, so that current, e.g., A.C. current, can be conducted through the rod blank via the clamping jaws.

In accordance with the invention, the current intensity is chosen so as to heat the central portion 3*a* of the clamped rod to a softening temperature, i.e., about 1300°–1600° C. for the particular resistor material, whereas the end portions 3*b* and 3*c* are kept at a temperature below the softening temperature, i.e., below 1300° C. in this particular case, e.g., through the natural dissipation of the heat generated in the resistor material to each of the clamping jaws 1,2. Hereby, a temperature gradient will appear in the rod blank between each clamping jaw and the middle or the central portion of the rod blank.

When such a temperature distribution has been obtained in the rod blank, at least one of the clamping jaws is brought along a predetermined path of movement adapted to the desired rod element configuration. This movement also comprises a certain necessary rotation of each clamping jaw (around an axis normal to the rod blank), and the relative movement of the clamping jaws can preferably be such, that a constant bending momentum is exerted at all times at the two transitions between the bending central portion 3*a* of the rod and its end portions 3*b*,3*c*, the latter, due to the lower temperature, being kept constantly straight during the bending process.

Preferably the length and thickness dimensions of the rod blank and the current intensity are adapted to each other in such a way that a temperature peak is obtained between the clamping jaws and a symmetrical temperature gradient appears on each side of the center of the rod, so that the bending process is performed symmetrically in relation to this center.

In general, either both or only one of the clamping jaws can be brought along a given path of movement. For example, if it is desirable to bend the wire blank into a wire element having a few, preferably three (Cf. FIGS. 2*a–d*) or five half helical turns, one or both of the clamping jaws, e.g., by eccentric mounting on a rotatable shaft, can be brought along an almost planar path of movement (e.g., in a spiral path, the eccentric distance being variable), and turned an axis parallel to the axis of the intended helix, in such a manner that the central rod portion 3*a* is being bent while obtaining a successively increasing, uniform curvature along the length thereof, substantially in a plane normal to said axis, whereas the end portions 3*b*, 3*c* are kept constantly straight. During this process, the clamping jaws are being somewhat displaced relative to each other in a direction parallel to said axis (Cf. FIGS. 2*a–d*). Clamping jaws 1, 2 can be both forcedly guided along predetermined path of movement extending substantially spirally with successively decreasing radius in opposite circumferential directions, or, alternatively, one clamping jaw can be forcedly guided along a circular path, while the other clamping jaw (by automatic or manual control) is brought along a spiral-like movement path (with step pitch) in the opposite circumferential direction. Arrows $P_1$ and $P_2$ shown in FIGS. 2*a–c* illustrate the direction in which each clamping jaw is to be guided during the bending process.

Experience has shown that, by heating the rod blank through current conduction and adapting the temperature distribution according to the above in order to keep the end portions *3b, 3c* rigid during the bending process, the formation of the coils can be easily controlled so as to produce a finished rod element having excellent qualities and being free from impurities.

By suitably adapting the relative movement of the clamping jaws, a desired rod element configuration can be obtained, at least if only a few coils are to be formed. Furthermore, the coils can be centered around different axes. The important feature is to keep the end portions of the rod blank straight, so that the bending can be performed in a controlled and preferably symmetrical manner.

We claim:

1. A method of hot bending a generally straight rod blank of ceramic material, having a diameter in the range of 0.4 to 0.1 mm, into a rod element having straight end portions and coils between said end portions, comprising the steps of (a) clamping said end portions of said rod blank by means of two clamping jaws movable relative to one another while leaving a central portion, 40 to 100 mm in length, of said rod blank unclamped;

(b) conducting through said rod blank an electric current of such intensity that said rod blank is heated to a softening temperature of 1300° to 1600° C. in said central portion, while said end portions are kept at a temperature below 1300° C.; and (c) moving at least one of said clamping jaws, during continued electric heating, along a path of movement adapted to a desired coil formation, whereby only said central rod portion is bent, while said end portions are kept substantially straight due to their lower temperature.

2. A method according to claim 1, wherein said electric current is conducted through said rod blank via said clamping jaws made of an electrically conductive material

3. A method according to claim 1 wherein said end portions of said rod blank are kept at a lower temperature than said central rod portion by heat dissipation to said clamping jaws made of a thermally conductive material.

4. A method according to claim 1, wherein the relative movement of said clamping jaws is such that an equally large bending momentum is exerted at said two transitions between the bending central portion of the rod blank and its constantly straight end portions.

5. A method according to claim 1, wherein the length and thickness dimensions as well as the current intensity are adapted to each other in such a way that a symmetrical temperature gradient appears on both sides of the center of the rod, i.e. centrally between said clamping jaws, so that the bending process is performed symmetrically in relation to this center.

6. A method according to claim 1, wherein, when hot bending the rod blank into a wire element having a few, especially three or five halves of helical turns, at least said one clamping jaw is brought along an almost planar path of movement and is turned about an axis parallel to the axis of the intended helix in such a manner that said central rod portion is being bent while obtaining a successively increasing uniform curvature along the length thereof, substantially in a plane normal to said axis, whereas said end portions adjoining said central portion of said rod blank are kept constantly straight, said clamping jaws being simultaneously somewhat displaced relative to each other in a direction parallel to said axis.

7. A method according to claim 6, wherein both of said clamping jaws are forcedly guided along predetermined paths of movement while simultaneous turning about axes parallel to said axis, said paths of movement extending in opposite circumferencial directions substantially spirally with successively decreasing radius.

8. A method according to claim 6, wherein one of said clamping jaws, through eccentric mounting on a rotatable shaft, is forcedly guided along a circular path, while the other clamping jaw is moved along a spiral-line path of movement in the opposite circumferential direction.

9. A method according to claim 6, wherein said rod blank consists substantially of molybdenum dicilicide.

10. A method according to claim 1, wherein said rod blank is bent 1½ turns with a final outer turn diameter of 3 to 12 mm.

* * * * *